US007023326B2

(12) United States Patent
Hwang

(10) Patent No.: US 7,023,326 B2
(45) Date of Patent: Apr. 4, 2006

(54) VIBRATION APPARATUS FOR A MOBILE TELECOMMUNICATION TERMINAL AND METHOD FOR CONTROLLING THE SAME

(75) Inventor: Seon-Woong Hwang, Suwon-shi (KR)

(73) Assignee: Samsung Electronics Co., Ltd., (KR)

( * ) Notice: Subject to any disclaimer, the term of this patent is extended or adjusted under 35 U.S.C. 154(b) by 418 days.

(21) Appl. No.: 10/154,544

(22) Filed: May 24, 2002

(65) Prior Publication Data

US 2002/0177419 A1 Nov. 28, 2002

(30) Foreign Application Priority Data

May 26, 2001 (KR) ..... 2001-29213

(51) Int. Cl.
*G08B 3/10* (2006.01)

(52) U.S. Cl. ..... 340/384.71; 340/566; 455/567

(58) Field of Classification Search ..... 340/384.7, 340/500, 545.4, 566, 582, 7.6, 384.71; 455/567
See application file for complete search history.

(56) References Cited

U.S. PATENT DOCUMENTS

| | | | | |
|---|---|---|---|---|
| 5,293,161 | A * | 3/1994 | MacDonald et al. | 340/7.6 |
| 5,436,622 | A * | 7/1995 | Gutman et al. | 340/7.6 |
| 5,894,263 | A * | 4/1999 | Shimakawa et al. | 340/388.1 |
| 6,281,785 | B1 * | 8/2001 | Hamaguchi | 340/407.1 |
| 6,509,671 | B1 * | 1/2003 | Takeda et al. | 310/316.01 |

* cited by examiner

*Primary Examiner*—Phung T. Nguyen
(74) *Attorney, Agent, or Firm*—Dilworth & Barrese LLP

(57) ABSTRACT

Disclosed is a vibration apparatus for generating vibration in a mobile terminal. The apparatus includes a vibrator for generating vibration; a frequency generator for generating a driving signal having a frequency within a predetermined frequency range in a predetermined time period; a driver for driving the vibrator using the driving signal provided from the frequency generator; and a frequency controller for periodically varying a frequency of the driving signal within the frequency range. Further, the vibration apparatus includes a vibration measurer for measuring vibration generated by the vibrator and providing the measured vibration values to the frequency controller. The frequency controller updates a frequency of the driving signal for driving the vibrator at a frequency indicating a maximum vibration value according to the measured vibration values.

15 Claims, 3 Drawing Sheets

VIBRATION APPARATUS FOR A MOBILE TELECOMMUNICATION TERMINAL AND METHOD FOR CONTROLLING THE SAME

PRIORITY

This application claims priority to an application entitled "Vibration Apparatus for a Mobile Telecommunication Terminal" filed in the Korean Industrial Property Office on May 26, 2001 and assigned Serial No. 2001-29213, the contents of which are hereby incorporated by reference.

BACKGROUND OF THE INVENTION

1. Field of the Invention

The present invention relates generally to a vibration apparatus and a method for controlling the same, and in particular, to a vibration apparatus for use in a mobile telecommunication terminal, for increasing the intensity of a vibration, and a method for controlling the same.

2. Description of the Related Art

In general, most mobile telecommunication terminals include a speaker for converting an electric signal into voice (sound) and a vibration device to generate vibration upon receipt of an incoming call.

FIG. 1 illustrates a structure of a common vibration device. Referring to FIG. 1, a common vibration device includes a magnet 1, a diaphragm 2, a vibration coil 3, a voice coil 4, a spring 5, and a housing 6. When current flows in the vibration coil 3, an electric field is generated. The electric field moves the magnet 1 in cooperation with a magnetic field of the magnet 1. FIG. 2 illustrates the movement of the magnet 1. The repeated movement of the magnet 1 generates induced current in the voice coil 4. As a result, the diaphragm 2 connected to the voice coil 4 vibrates. As the direction of the current supplied to the vibration coil 4 changes more frequently, the magnet 1 moves faster.

A resonance frequency driving the vibration device is determined in the manufacturing process of the mobile telecommunication terminal (hereinafter, referred to "mobile terminal" for short) on the basis of the resonance points of the vibration device and the entire mobile terminal with the vibration device. The resonance points of the vibration device and the entire mobile terminal are determined by the material and the weight of the mobile terminal and the way of carrying the mobile terminal. The resonance frequency can be changed due to a physical shock caused by falling or a change in the weight of the mobile terminal with the vibration device.

For example, a mobile terminal indicating receipt of an incoming call by generating vibration is manufactured to be relatively small in size so that it can be carried in various ways. For example, the mobile terminal can be worn about the neck of a user, held in one hand of the user, or put into the pocket or the bag of the user. The resonance frequency of the entire mobile terminal with the vibration device varies according to the way of carrying the mobile terminal. Also, the resonance frequency changes according to the weight of the battery mounted on the mobile terminal.

FIG. 3 illustrates a change in the intensity of vibration according to a change in the weight of the mobile terminal with the vibration device. Referring to FIG. 3, the mobile terminals having the weights of 80 g, 100 g and 120 g have their maximum vibration intensities at the resonant frequencies of 183 Hz, 181 Hz and 180 Hz, respectively.

The vibration device is driven by a driving signal, a resonance frequency of which is determined in the manufacturing process of the mobile terminal with the vibration device. Therefore, it is not possible to cope with the change in the resonance frequency at which the maximum vibration intensity occurs, due to the aging of the mobile terminal, the physical shock, and the change in the weight.

SUMMARY OF THE INVENTION

It is, therefore, an object of the present invention to provide a vibration apparatus capable of preventing a reduction in vibration intensity due to a change in weight of a mobile terminal with a resonance device.

It is another object of the present invention to provide a vibration apparatus capable of extending a resonance frequency band by periodically varying a frequency of a driving signal of a resonance device.

It is further another object of the present invention to provide a vibration apparatus capable of obtaining the maximum vibration intensity even when a resonance point changes due to the aging of a mobile terminal, a physical shock, or the change in the weight of the mobile terminal.

In accordance with one aspect of the present invention, there is provided a vibration apparatus for generating vibration for use in a mobile terminal. The apparatus comprises a vibrator for generating vibration; a frequency generator for generating a driving signal having a frequency within a predetermined frequency range in a predetermined time period; a driver for driving the vibrator using the driving signal provided from the frequency generator; and a frequency controller for periodically varying a frequency of the driving signal within the frequency range.

In accordance with another aspect of the present invention, there is provided a vibration apparatus for generating a vibration in a mobile terminal. The vibration apparatus comprises a vibrator for generating vibration; a frequency generator for generating a driving signal having a predetermined frequency; a driver for driving the vibrator according to the driving signal provided from the frequency generator; a vibration measurer for measuring the vibration generated by the vibrator; and a frequency controller for changing the frequency of the driving signal according to the measured vibration.

In accordance with another aspect of the present invention, there is provided a method for controlling a vibration apparatus for generating a vibration in a mobile terminal. The method comprises periodically changing a frequency of a driving signal within a first frequency range; generating vibration according to the driving signal having the periodically changed frequency, and then measuring vibration values every time period; comparing the measured vibration values every time period and selecting a frequency indicating a maximum vibration value within the first frequency range; and determining the selected frequency as a frequency of the driving signal.

In accordance with another aspect of the present invention, there is provided a method for controlling a vibration apparatus for generating a vibration in a mobile terminal. The method comprises periodically changing a frequency of a driving signal within a first frequency range; generating vibration according to the driving signal having the periodically changed frequency, and then measuring vibration values every time period; comparing the measured vibration values every time period and selecting a frequency indicating a maximum vibration value within the first frequency range; and periodically changing a frequency of the driving signal within a second frequency range centered on the selected frequency.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail. The terms used herein are defined in consideration of the functions of elements in the present invention. The terms can be changed according to the intentions or the customs of a user and an operator.

The present invention is characterized by preventing a reduction in the vibration intensity due to a change in weight of the mobile terminal by periodically and sequentially changing driving frequencies that provide a driving signal to a vibration device.

As mentioned above, a resonance frequency, at which a mobile terminal with the vibration device has the maximum vibration intensity, changes according to the weight of the mobile terminal. Therefore, the present invention is characterized by providing an apparatus for periodically varying a frequency of a driving signal of the vibration device within a possible range. Here, the frequency of the driving signal varies within a range where the mobile terminal can obtain the maximum vibration intensity within a possible range of the weight change.

The structure of the present invention for realizing the above mentioned operational principle will now be described.

Figure 4:
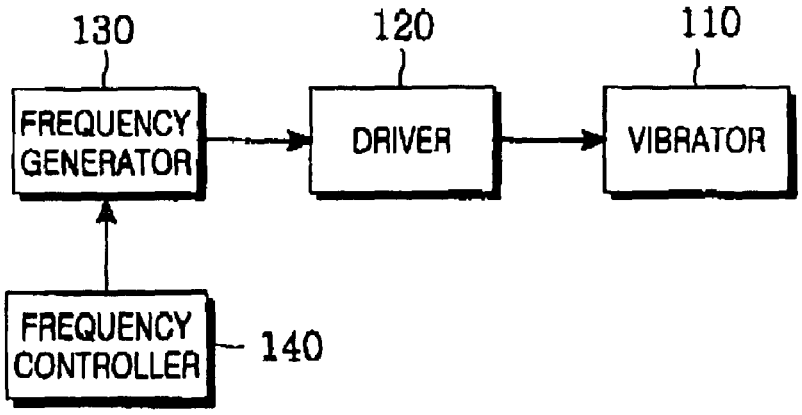
FIG. 4 illustrates a structure of a vibration apparatus according to a first embodiment of the present invention.

FIG. 4 illustrates a structure of a vibration apparatus according to a first embodiment of the present invention. Referring to FIG. 4, a vibration apparatus according to the present invention includes a vibrator 110 for generating vibration, a frequency generator 130 for generating a driving signal having a predetermined frequency, a driver 120 for providing the driving signal to the vibrator 110, to thus drive the vibrator 110, and a frequency controller 140 for controlling a frequency of the driving signal.

Figure 1:
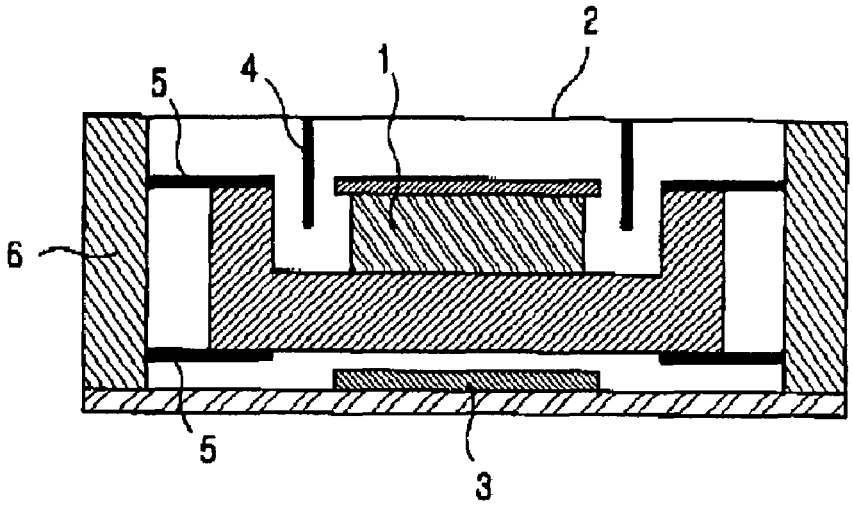
FIG.1 (PRIOR ART)
FIG. 1 illustrates a structure of a common vibration device.
Figure 2:
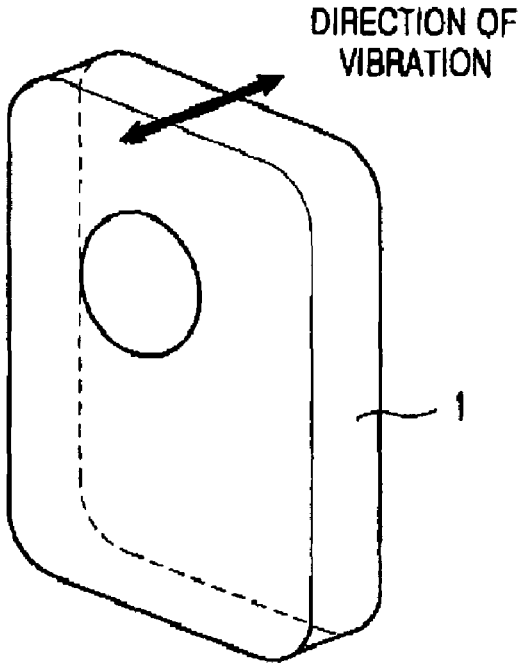
FIG.2 (PRIOR ART)
FIG. 2 illustrates the movement of a magnet.

The vibrator 110 can be comprised of the vibration device shown in FIG. 1. To be more specific, the vibrator 110 includes a vibration coil driven by the driver 120 and a magnet that moves in reaction to the electric field generated by the vibration coil. The driver 120 supplies current to the vibration coil in response to the driving signal provided by the frequency generator 130. The supplied current is alternating current (AC) whose direction changes at predetermined periods (or frequency). A frequency of the current is determined by the frequency controller 140.

Figure 3:
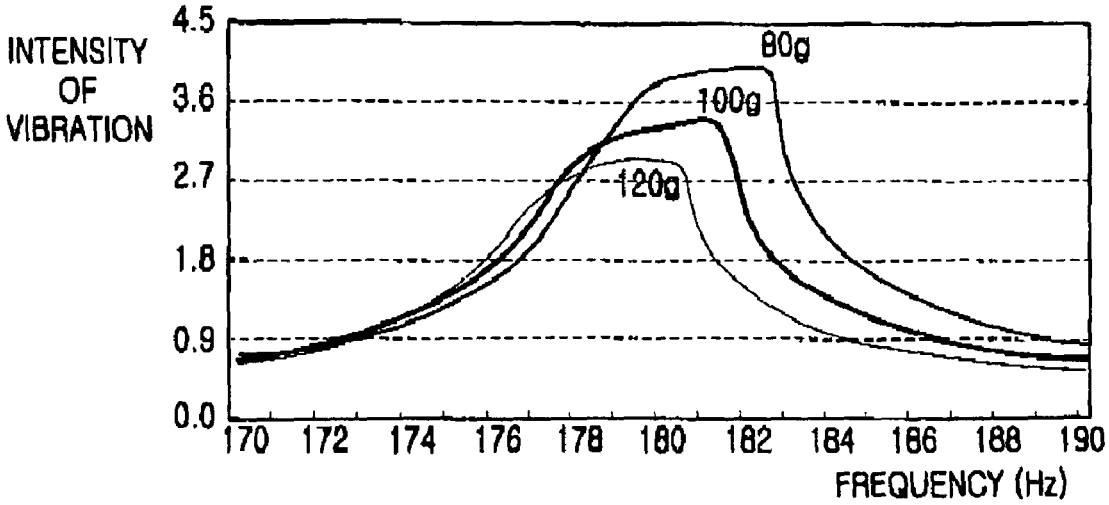
FIG.3 (PRIOR ART)
FIG. 3 illustrates a change in the intensity of vibration due to a change in the weight of a mobile terminal with the vibration device.

The frequency controller 140 includes a memory (not shown) for storing at least two frequencies determined within a range based on the resonance frequencies of the vibrator 110 and the entire mobile terminal with the vibration apparatus of FIG. 4, and a control processor for controlling the frequency generator 130 using the frequency values stored in the memory. The frequencies stored in the memory are determined in consideration of a possible change in a resonance point of the entire mobile terminal. Referring to FIG. 3, the stored frequencies can for example be 180 Hz, 181 Hz, and 183 Hz. The change in the resonance point can be caused for example by the way the mobile terminal is carried and the weight of the battery. The frequency values and the period value, at which the frequency values change, are stored in the memory in the frequency controller 140.

Figure 5:
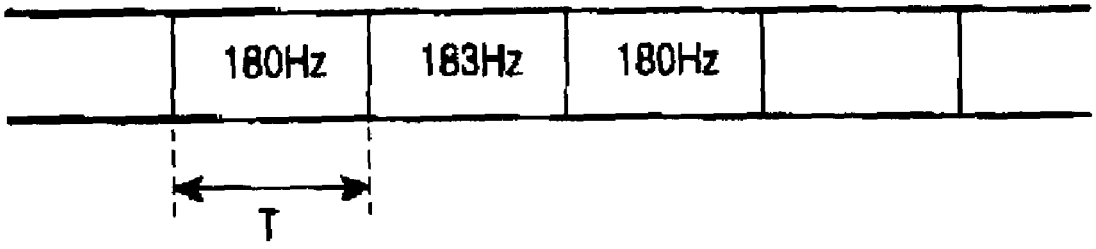
FIG. 5 illustrates how the frequency generator of FIG. 4 generates a driving signal.

The frequency generator 130 is comprised of an oscillator for generating a driving signal having the frequency controlled by the frequency controller 140. The frequency of the driving signal periodically varies within the predetermined frequency range. In a preferred embodiment, the driving signal has a frequency selected among at least two frequencies in a predetermined time period. That is, the frequency generator 130 periodically outputs a driving signal having a first frequency in a first time period, a driving signal having a second frequency in a second time period, and a driving signal having an Nth frequency in an Nth time period. The driving signal having the first frequency is output again in an (N+1)th time period. FIG. 5 illustrates how the frequency generator 130 generates the driving signals by way of example. Preferably, the driving signal is comprised of at least two frequencies, which alternate every time period, but can be comprised of more frequencies depending on the particular circumstances. As illustrated in FIG. 5, the frequency generator 130 repeatedly generates the frequencies of 180 Hz and 183 Hz at periods of, e.g., one second.

Figure 6:
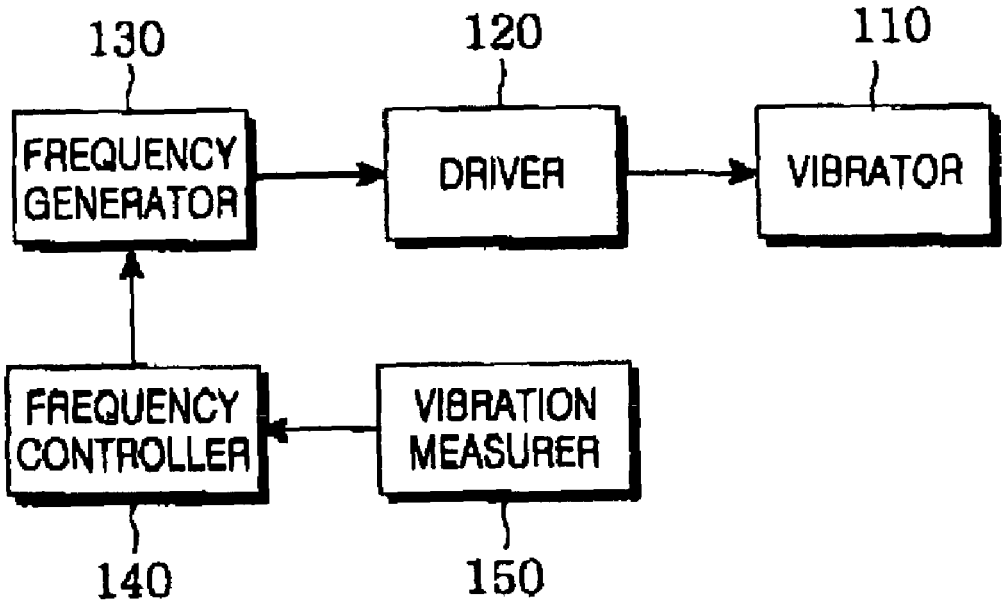
FIG. 6 illustrates a structure of a vibration apparatus according to a second embodiment of the present invention.

FIG. 6 illustrates a structure of a vibration apparatus according to a second embodiment of the present invention. Referring to FIG. 6, a vibration apparatus according to the second embodiment of the present invention includes a vibrator 110 for generating vibration, a frequency generator 130 for generating a driving signal having a predetermined frequency, a driver 120 for providing the driving signal to the vibrator 110, to thus drive the vibrator 110, a frequency controller 140 for controlling a frequency of the driving signal, and a vibration measurer 150 for measuring vibration of the entire mobile terminal and providing the measured vibration to the frequency controller 140.

The vibrator 110, the driver 120 and the frequency generator 130 operate in the same way as described in conjunction with FIG. 4, so a detailed description of them will not be made. The description of the vibration apparatus will be limited to the operation of the frequency controller 140 and the vibration measurer 150.

As the vibration apparatus initiates an operation, the frequency controller 140 periodically controls the frequency generator 130 within a first frequency range. Here, the first frequency range is defined to include a preset resonance frequency of the vibration apparatus. The frequency generator 130 generates a driving signal having a frequency controlled by the frequency controller 140. A frequency of the driving signal is sequentially changed through a plurality of frequencies previously set within the first frequency range. The driver 120 drives the vibrator 110 depending on the driving signal.

When the mobile terminal with the vibration apparatus of FIG. 6 is vibrated by the vibrator 110, the vibration measurer 150 measures vibration of the entire mobile terminal. To this end, the vibration measurer 150 includes a vibration sensor. The vibration measured by the vibration measurer 150 should have a different value each time period, as there is a change in the frequency of the driving signal during each time period. The vibration measured by the vibration measurer 150 is converted to an analog signal or a digital signal, and then provided to the frequency controller 140.

The frequency controller 140 compares for each time period the vibration values measured by the vibration measurer 150, and selects an optimal frequency indicating the maximum vibration among the frequencies within the first frequency range. The frequency controller 140 determines a frequency of the driving signal generated by the frequency generator 130 as the optimal frequency.

In an alternative embodiment, the frequency controller 140 periodically controls a frequency of the driving signal within a second frequency range centered on the optimal frequency. Here, the second frequency range is equal to or narrower than the first frequency range.

For example, the first frequency range includes N frequencies, so the vibration measurer 150 measures N vibration values corresponding to the N frequencies. If an $i^{th}$ vibration value among the N measured vibration values is maximum, the frequency controller 140 controls the driving signal generated by the frequency generator 130 using the N frequencies within second frequency range centered on the $i^{th}$ vibration value. Preferably, the driving signal is comprised of at least two frequencies, which alternate each time period.

In sum, the present invention secures a wide resonance frequency band using the frequency controller 140 that varies the frequency of the driving signal within the previously determined range. Therefore, the mobile terminal with the vibration apparatus according to the present invention can obtain the maximum vibration intensity by extending the resonant frequency band of the driving signal without modification of the vibration device. In addition, a frequency of the driving signal for driving the vibrator 110 is updated considering the vibration values measured within a predetermined frequency range. That is, the frequency of the driving signal can be maintained at a frequency indicating the maximum vibration value.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A vibration apparatus for generating a vibration in a mobile terminal, the apparatus comprising:

a vibrator for generating vibration;

a frequency generator for generating a driving signal having a frequency within a predetermined frequency range for a predetermined time period, the predetermined frequency range and the predetermined time period being determined according to a resonance point of the mobile terminal;

a driver for driving the vibrator according to the driving signal provided from the frequency generator; and a frequency controller for periodically varying the frequency of the driving signal within the predetermined frequency range.

2. The vibration apparatus of claim 1, wherein the driving signal comprises a frequency selected among at least two predetermined frequencies in a predetermined time period.

3. The vibration apparatus of claim 1, wherein the time period is one second.

4. The vibration apparatus of claim 2, wherein the driving signal comprises at least two predetermined frequencies, which alternate each time period.

5. The vibration apparatus of claim 1, wherein the predetermined frequency range is defined to include a preset resonance frequency of the vibrator.

6. A vibration device for generating a vibration in a mobile terminal, comprising:

a vibrator for generating vibration at a predetermined vibration frequency, the predetermined vibration frequency determined according to a resonance point of the mobile terminal;

a controller for controlling the vibrator; and a memory for storing a plurality of predetermined vibration frequencies determined in consideration of possible changes in the resonance point of the mobile terminal, wherein the controller varies the vibration frequency between the predetermined vibration frequencies.

7. The apparatus of claim 6, wherein the variation occurs at one second intervals.

8. A vibration apparatus for generating a vibration in a mobile terminal, comprising:

a vibrator for generating vibration;

a frequency generator for generating a driving signal having a predetermined frequency, the predetermined frequency determined according to a resonance point of the mobile terminal;

a driver for driving the vibrator according to the driving signal provided from the frequency generator;

a vibration measurer for measuring the vibration generated by the vibrator; and a frequency controller for determining a frequency of the driving signal according to the measured vibration and for changing to another predetermined vibration frequency from among a plurality of predetermined vibration frequencies determined in consideration of possible changes in the resonance point of the mobile terminal.

9. The vibration apparatus of claim 8, wherein the frequency controller periodically changes at successive time periods the frequency of the driving signal within a first frequency range at initial driving, compares vibration values measured by the vibration measurer each time period, selects a frequency indicating a maximum vibration value within the first frequency range, and sets the selected frequency as a frequency of the driving signal.

10. The vibration apparatus of claim 8, wherein the frequency controller periodically changes the frequency of the driving signal within a first frequency range at initial driving, compares vibration values measured by the vibration measurer each time period, selects a frequency indicating a maximum vibration value within the first frequency range, and periodically changes a frequency of the driving signal within a second frequency range centered on the selected frequency.

11. The vibration apparatus of claim 10, wherein the driving signal comprises a frequency selected from at least two predetermined frequencies within the second frequency range.

12. The vibration apparatus of claim 10, wherein the time period is one second.

13. A method for controlling a vibration apparatus for generating a vibration in a mobile terminal, comprising the steps of:

periodically changing at successive time periods a frequency of a driving signal within a first frequency range, the first frequency range determined by a resonance point of the mobile terminal;

generating vibration according to the driving signal having the periodically changed frequency, and then measuring vibration values each time period;

comparing the measured vibration values each time period and selecting a frequency indicating a maximum vibration value within the first frequency range; and setting the selected frequency as a frequency of the driving signal.

14. A method for controlling a vibration apparatus for generating a vibration in a mobile terminal, comprising the steps of:

a) periodically changing a frequency of a driving signal within a first frequency range at successive time periods, the first frequency range determined according to a resonance point of the mobile terminal;

b) generating vibration according to the driving signal having the periodically changed frequency, and then measuring vibration values each time period;

c) comparing the measured vibration values each time period and selecting a frequency indicating a maximum vibration value within the first frequency range; and d) periodically changing a frequency of the driving signal with a second frequency range centered on the selected frequency.

15. The method of claim 14, wherein a frequency selected among at least two predetermined frequencies within the second frequency range for a predetermined time period is determined as a frequency of the driving signal.

* * * * *